US011594205B2

(12) United States Patent
Imamura et al.

(10) Patent No.: US 11,594,205 B2
(45) Date of Patent: Feb. 28, 2023

(54) SWITCH DEVICE, ELECTRONIC APPARATUS, AND ELECTRONIC MUSICAL INSTRUMENT

(71) Applicant: CASIO COMPUTER CO., LTD., Tokyo (JP)

(72) Inventors: Naoto Imamura, Oume (JP); Kouji Oshima, Fussa (JP); Yuuki Nakajima, Akishima (JP); Mari Nakajima, Tachikawa (JP); Ryohei Kobayashi, Hino (JP); Shingo Fukushima, Akishima (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 17/537,414

(22) Filed: Nov. 29, 2021

(65) Prior Publication Data

US 2022/0180847 A1 Jun. 9, 2022

(30) Foreign Application Priority Data

Dec. 9, 2020 (JP) ..... JP2020-204073

(51) Int. Cl.
*G10H 1/34* (2006.01)
*G10H 1/00* (2006.01)

(52) U.S. Cl.
CPC ..... *G10H 1/0016* (2013.01); *G10H 1/344* (2013.01)

(58) Field of Classification Search
CPC ..... G10H 1/0016; G10H 1/344
See application file for complete search history.

(56) References Cited

U.S. PATENT DOCUMENTS 5,235,636 A * 8/1993 Takagi ..... H04M 1/0202 379/422
6,743,993 B1 * 6/2004 Clark ..... H01H 13/702 200/314
6,930,263 B2 * 8/2005 Hung ..... H01H 9/226 200/333
6,969,815 B1 * 11/2005 Lu ..... H01H 13/705 200/345
6,997,572 B2 * 2/2006 Ono ..... H01H 13/702 362/23.06
7,041,922 B2 * 5/2006 Geiger ..... H01H 13/70 200/314

(Continued)

FOREIGN PATENT DOCUMENTS

JP S5998524 U 7/1984
JP H0269428 U 5/1990

(Continued)

OTHER PUBLICATIONS

Indian First Examination Report dated Jun. 28, 2022, (and English translation thereof) issued in counterpart Indian Application No. 202114055494.

(Continued)

*Primary Examiner* — Robert W Horn
(74) *Attorney, Agent, or Firm* — Holtz, Holtz & Volek PC

(57) ABSTRACT

A switch device (4, 5) includes: a cap (7) including, on a top surface (711), a first region (71*a*) and a second region (71*b*) corresponding to a position where an internal light (133) is disposed and being thinner than the first region (71*a*); and a switch (61, 62) to which the cap (7) is mounted.

17 Claims, 6 Drawing Sheets

(56) References Cited

U.S. PATENT DOCUMENTS

| | | | | |
|---|---|---|---|---|
| 7,060,883 | B2 * | 6/2006 | Nagaoka | G10H 1/344 84/423 R |
| 7,122,756 | B2 * | 10/2006 | Sasaki | H01H 13/28 200/520 |
| 7,151,212 | B2 * | 12/2006 | Nagaoka | G10H 1/344 84/436 |
| 7,230,196 | B2 * | 6/2007 | Toyama | H01H 13/023 200/341 |
| 7,309,829 | B1 | 12/2007 | Ludwig | |
| 7,514,643 | B1 * | 4/2009 | Tittle | H01H 13/023 200/314 |
| 7,554,047 | B2 * | 6/2009 | Verdu | H01H 13/023 200/341 |
| 8,063,326 | B2 * | 11/2011 | Igarashi | H01H 13/83 200/310 |
| 8,934,088 | B2 * | 1/2015 | Lambert | G10H 1/34 356/28 |
| 9,305,721 | B2 * | 4/2016 | Izawa | H01H 13/023 |
| 9,362,066 | B2 * | 6/2016 | Izawa | H01H 13/20 |
| 10,079,125 | B2 * | 9/2018 | Izawa | H01H 13/023 |
| 10,211,006 | B2 * | 2/2019 | Liao | G02B 6/0008 |
| 10,304,430 | B2 * | 5/2019 | Nakamura | G10H 1/0008 |
| 11,004,628 | B2 * | 5/2021 | Izawa | H01H 13/705 |
| 11,189,441 | B2 * | 11/2021 | Izawa | H01H 3/125 |
| 2003/0226745 | A1 * | 12/2003 | Sato | H01H 13/807 200/5 R |
| 2006/0000699 | A1 * | 1/2006 | Sasaki | H01H 13/023 200/341 |
| 2017/0011871 | A1 * | 1/2017 | Izawa | H01H 13/83 |
| 2017/0109127 | A1 * | 4/2017 | Osborn | G06F 3/0482 |
| 2019/0259359 | A1 | 8/2019 | Ludwig | |
| 2022/0180847 | A1 * | 6/2022 | Imamura | G10H 1/0016 |

FOREIGN PATENT DOCUMENTS

| | | | |
|---|---|---|---|
| JP | H0282829 | U | 6/1990 |
| JP | H02150622 | U | 12/1990 |
| JP | 2006302555 | A | 11/2006 |

OTHER PUBLICATIONS

Japanese Office Action (and English language translation thereof) dated Nov. 10, 2022, issued in counterpart Japanese Application No. 2020-204073.

* cited by examiner

SWITCH DEVICE, ELECTRONIC APPARATUS, AND ELECTRONIC MUSICAL INSTRUMENT

CROSS-REFERENCE TO RELATED APPLICATION

The present application claims priority based on Japanese Patent Application No. 2020-204073 filed in Japan on Dec. 9, 2020, the entire contents of which are incorporated herein by reference in its entirety.

The present disclosure relates to a switch device, an electronic apparatus, and an electronic musical instrument.

BACKGROUND

For example, disclosed is a configuration that a switch device (push button device) of JP 2006-302555 A has a rubber switch in which a light guide portion for transmitting light from an LED is formed, and a resin button formed so as to cover a part of an outer wall surface from a light guide surface of the light guide portion of the rubber switch, in which the light guide portion is formed into a shape concentrating and guiding light from the LED to a part of an operation surface of the resin button.

SUMMARY

A switch device according an embodiment includes: a cap including, on a top surface, a first region and a second region corresponding to a position where an internal light is disposed and being thinner than the first region; and a switch to which the cap is mounted.

An electronic apparatus according to an embodiment includes: the above switch device; and a processor for executing processing corresponding to an operation to the switch device to be detected.

DETAILED DESCRIPTION

Figure 1:
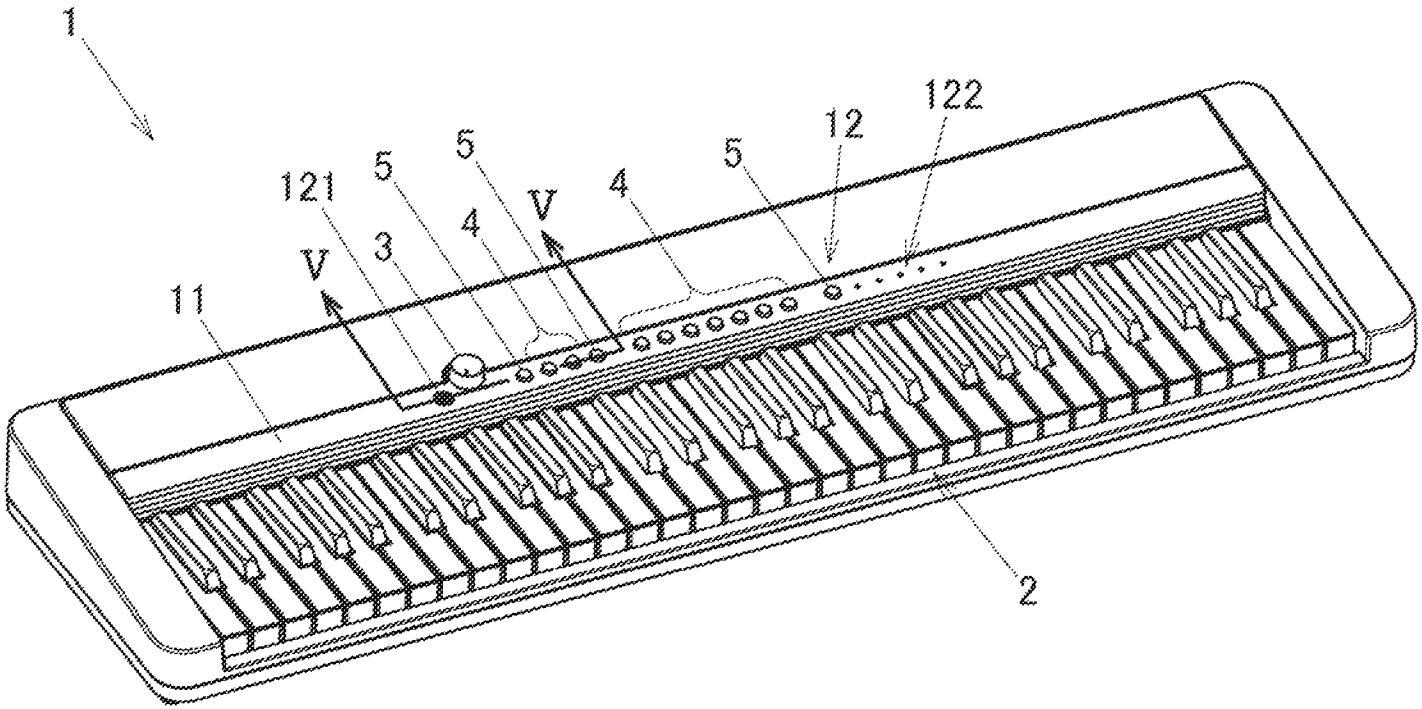
FIG. 1 is a perspective view of a keyboard instrument according to an embodiment.

Embodiments will be described with reference to the drawings. FIG. 1 is a perspective view of a keyboard instrument 1 as viewed from the front side. An electronic piano (an electronic apparatus including an electronic musical instrument) is illustrated as the keyboard instrument 1 of the present embodiment. The keyboard instrument 1 has a plurality of keys 2 for designating pitch as a performance operating element, and is formed in a long flat plate shape in the arrangement direction of the keys 2 (right and left direction as seen from a player). In the following description, the near side as seen from the player of the keyboard instrument 1 is referred to as the front, the opposite side of the near side is referred to as the rear, the left side as seen from the player is referred to as the left, and the opposite side of the left side is referred to as the right. The side on which the switch devices 4 and 5 of the keyboard instrument 1 are disposed is referred to as the upper and the opposite side of the upper is referred to as the lower.

The keyboard instrument 1 includes an exterior case 11, where an opening provided in a part of the exterior case 11 is provided with the key 2 and an operation unit 12. The sound generated by the key pressing operation is emitted from an internal speaker positioned in the rear of the key 2 and emitted to the outside through an opening, which is not illustrated in the figure, provided on the upper surface of the exterior case 11. The operation unit 12 is disposed on the rear side of the key 2. The operation unit 12 includes a power button 121, a dial 3, switch devices 4 and 5 serving as operation buttons (push buttons) for selecting and determining various settings, and an indicator 122. The switch device 4 includes a light emitting element 133 to be described below. The switch device 4 emits light, for example, during a depression operation. The switch device 5 does not have a light emitting function, but the appearance exposed from the exterior case 11 is constituted in the same manner as the switch device 4. The use of one or a plurality of switch devices 4 and 5 in the operation unit 12 enables the tone of a piano, an organ or other musical instruments to be changed and the changed tone to be registered. A plurality of the indicators 122 notify information set by the switch devices 4 and 5 or other devices, by lighting by light emitting elements such as LEDs disposed inside.

Figure 2:
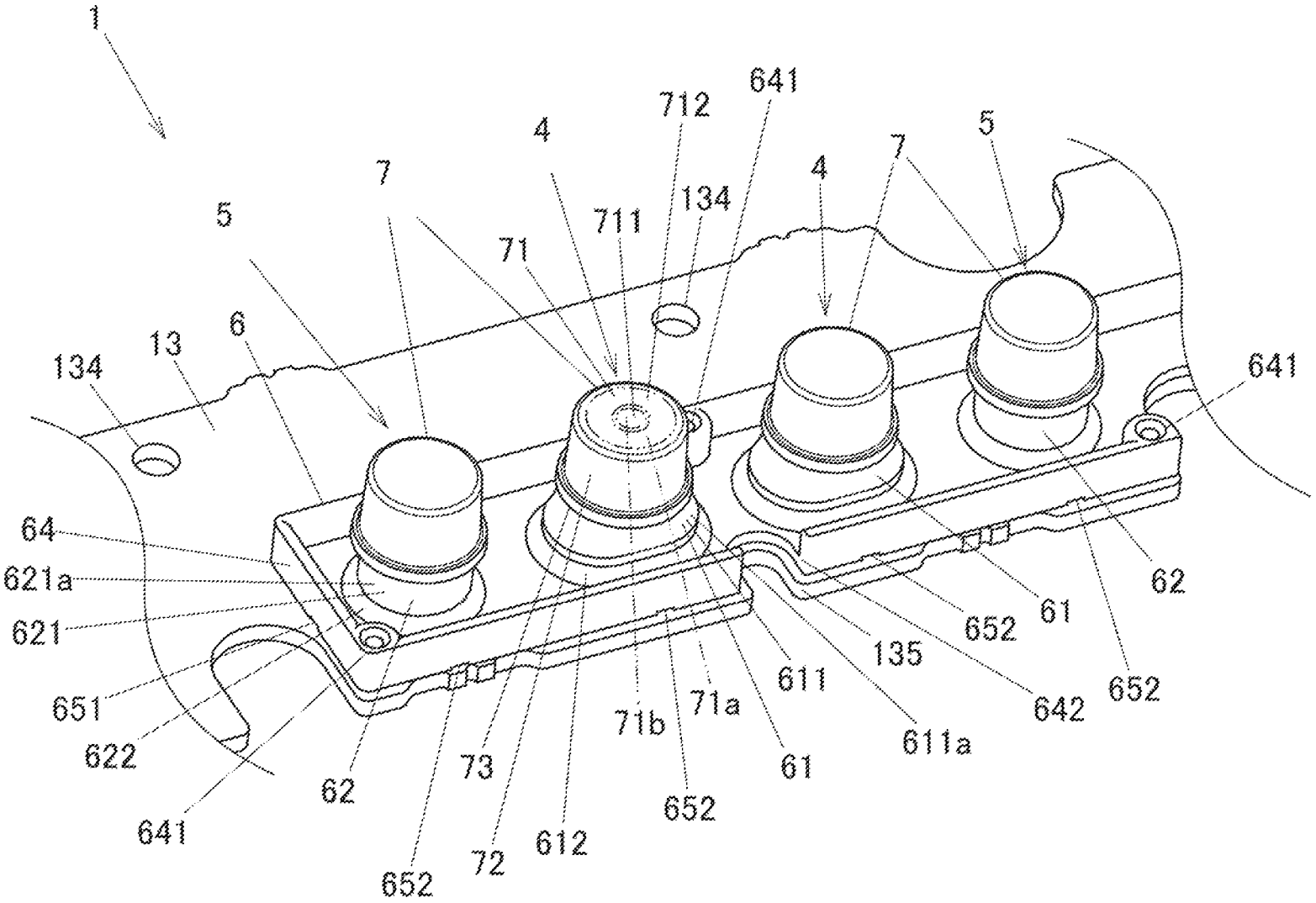
FIG. 2 is a perspective view of a switch device according to the embodiment.

FIG. 2 is a perspective view of the switch devices 4 and 5 in a state in which the exterior case 11 is omitted. FIG. 2 illustrates the switch devices 4 and 5 adjacent to the dial 3 in FIG. 1. The keyboard instrument 1 has a circuit board 13, a rubber switch array 6 disposed on the circuit board 13, and a cap 7 mounted on switches 61 and 62 provided on the rubber switch array 6, inside the exterior case 11. The cap 7 corresponds to a key top in the switch devices 4 and 5. The switch device 4 includes a switch 61, a cap 7, and a circuit board 13. The switch device 5 includes a switch 62, a cap 7, and a circuit board 13.

Figure 3:
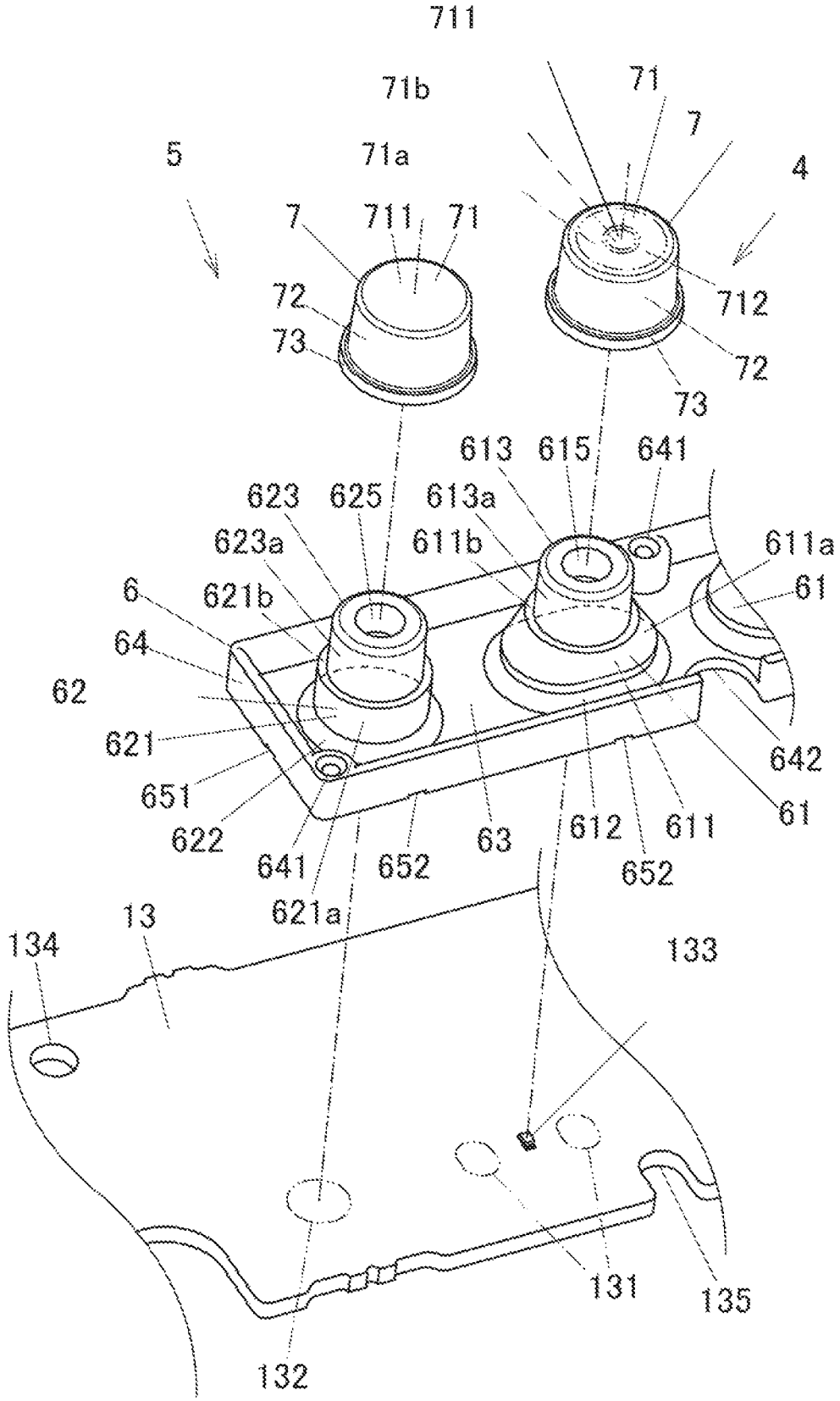
FIG. 3 is an exploded perspective view of the switch device according to the embodiment.

As illustrated in an exploded perspective view of the switch devices 4 and 5 in FIG. 3, the circuit board 13 has a contact electrode 131 and 132 and a light emitting element 133 serving as an internal light. The contact electrodes 131 and 132 in FIG. 3 schematically illustrate a region in which an electrode pattern is formed by a two-dot chain line. The contact electrodes 131 and 132 are provided so that the comb-shaped electrodes on the positive electrode side and the negative electrode side are engaged with each other in an open state. In the contact electrodes 131 and 132, the comb-shaped electrodes on the positive electrode side and the negative electrode side are short-circuited and conducted by contact of the contacts 616 and 626 to be described below, thereby enabling the depression operation of the switch devices 4 and 5 (the switch 61 and the switch 62) to be detected by a detection unit, which is not illustrated in the figure, provided on, for example, the circuit board 13. Although a white LED element is used as the light emitting element 133 of the present embodiment, a light emitting element including a plurality of LED chips of red, green and blue may be disposed to be able to emit any color light. The light emitting element 133 emits light toward the top surface 71 side (see FIG. 5) of the cap 7 disposed thereabove.

The circuit board 13 is provided with a mounting portion 134 serving as an opening and a mounting portion 135 serving as a notch. The circuit board 13 is fixed to the exterior case 11 from its inside by the mounting portion 134, using a screw member. The rubber switch array 6 is also fastened together with the mounting portion 135 of the circuit board 13 by a screw member through a mounting portion 642 serving as a notch and fixed to the exterior case 11.

The rubber switch array 6 can be formed of an insulating elastic material such as natural rubber or synthetic rubber. The rubber switch array 6 is formed long in the right and left direction (a part of the left end portion side is illustrated in FIG. 3). The rubber switch array 6 has a flat plate shape bottom portion 63, a plurality of switches 61 and 62 provided on the bottom portion 63, and a side wall portion 64 disposed so as to surround the outer periphery of the bottom portion 63.

Figure 5:
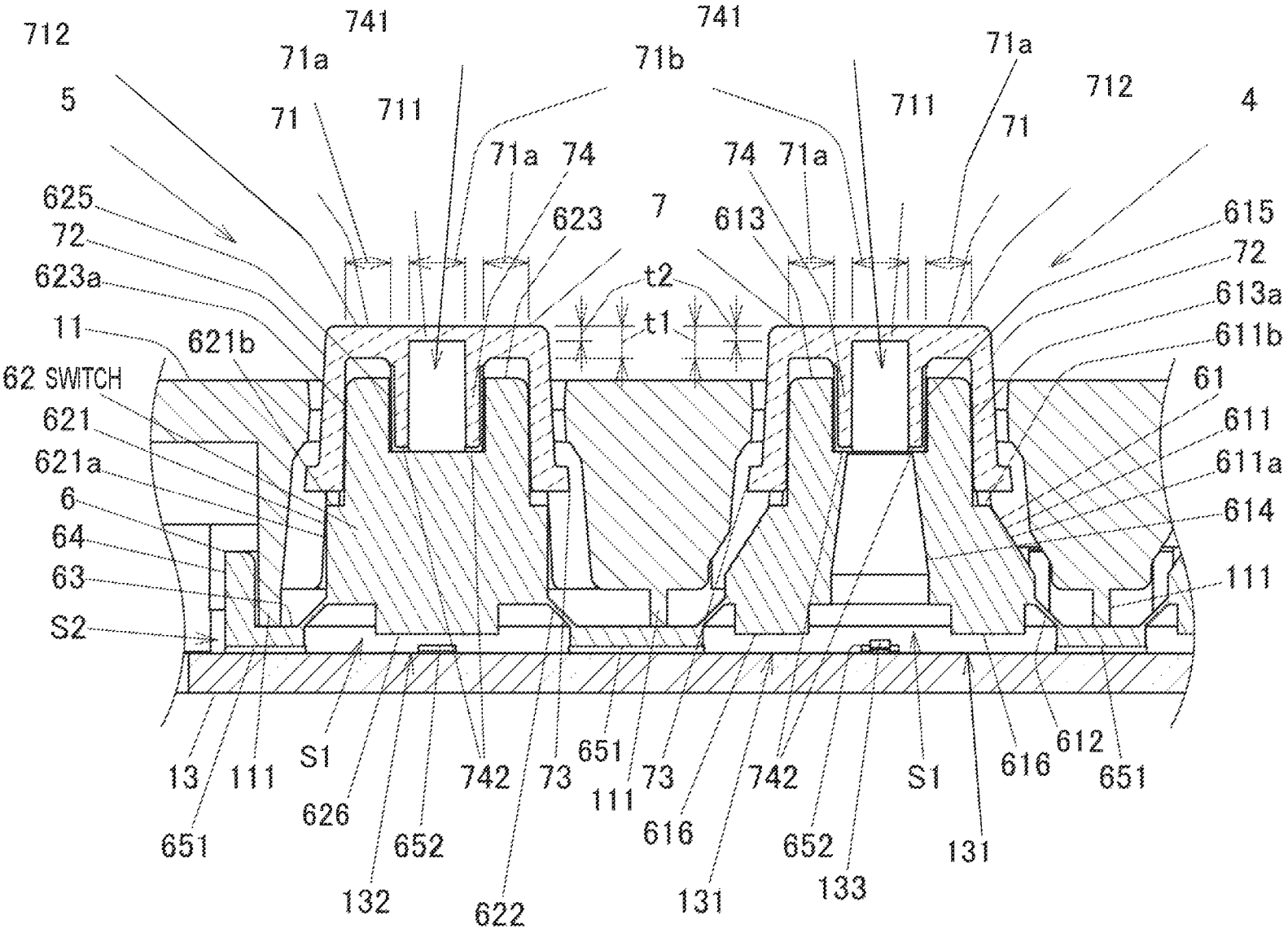
FIG. 5 is a view illustrating a state before the switch device is operated in a V-V cross section where the area around the switch device of the keyboard instrument in FIG. 1 according to the embodiment is enlarged.

As illustrated in FIG. 5, the switch 61 is provided in a cylindrical shape penetrating vertically. The switch 61 has a truncated-cone shaped base portion 611 whose outer shape is long in the right and left direction, a skirt portion 612 connecting the base portion 611 and the bottom portion 63, and a columnar head portion 613 whose outer shape is provided above the base portion 611. The skirt portion 612 is a thin-walled portion provided over the whole periphery at the lower end portion of the base portion 611. The skirt portion 612 is extended in the state in FIG. 5 where the skirt portion is not subjected to an external force, to bias the base portion 611 and the head portion 613 to which the cap 7 is mounted upward, and can be bent in the state in FIG. 6 where the switch 61 is depressed via the cap 7, to bring the base portion 611 and the head portion 613 close to the circuit board 13 side below. Therefore, the switch 61 is provided to be vertically movable by the skirt portion 612.

As illustrated in FIG. 3, the outer surface 611*a* of the base portion 611 is inclined in a divergent shape. The outer surface 613*a* of the head portion 613 is formed to have substantially the same diameter over the upper and lower portions. The outer surface 611*a* and the outer surface 613*a* are connected via a step portion 611*b*.

The switch 61 illustrated in FIG. 5 has a light side light guide portion 614 and a housing portion 615, which are through-holes having a substantially circular cross section and penetrating in the vertical direction, provided therein. The light side light guide portion 614 and the housing portion 615 are coaxially adjacently provided. The entire light side light guide portion 614 is formed so that its inner diameter is reduced upward, and a part of the opening side of the lower end is formed to have substantially the same diameter.

The housing portion 615 positioned above the light side light guide portion 614 is formed to have a larger diameter than the inner diameter of the upper end portion of the light side light guide portion 614. The inner diameter of the housing portion 615 is provided to have substantially the same diameter over the vertical direction. The housing portion 615 can house a cylindrical portion 74 (top surface side light guide portion 741) of a cap 7 to be described below. The inner diameter of the housing portion 615 is provided to be larger than the outer diameter of the cylindrical portion 74.

The switch 61 has a columnar contact 616 projecting from the lower surface to the downward side (i.e., the circuit board 13 side) at a position different from the light side light guide portion 614 on the lower surface of the base portion 611. The contacts 616 are provided at two positions facing the contact electrodes 131. A conductor portion is provided on the surface of the contact 616 facing the contact electrode 131 by, for example, plating or vapor deposition. Therefore, when the contact 616 comes into contact with the contact electrode 131, the open ends of the contact electrode 131 on the positive electrode side and the negative electrode side can be short-circuited.

As illustrated in FIG. 5, the switch 62 is provided in a solid substantially columnar shape relative to the cylindrical switch 61. The switch 62 has a columnar base portion 621, a skirt portion 622 connecting the base portion 621 and the bottom portion 63, and a head portion 623 whose outer shape provided above the base portion 621 is columnar. The skirt portion 622 is a thin-walled portion provided over the whole periphery at the lower end portion of the base portion 621. The skirt portion 622 is extended in the state in FIG. 5 where the skirt portion is not subjected to an external force, to bias the base portion 621 and the head portion 623 to which the cap 7 is mounted upward, and can be bent in the state in FIG. 6 where the switch 62 is depressed via the cap 7, to bring the base portion 621 and the head portion 623 close to the circuit board 13 side below. Therefore, the switch 62 is provided to be vertically movable by the skirt portion 622.

As illustrated in FIG. 3, the outer surface 621*a* of the base portion 621 is formed to have substantially the same diameter over the upper and lower portions, and the outer surface 623*a* of the head portion 623 is also formed to have substantially the same diameter over the upper and lower portions. The outer surface 623*a* has a diameter substantially the same as that of the outer surface 613*a* of the switch 61, and is formed to have a diameter smaller than that of the outer surface 621*a*. The outer surface 621*a* and the outer surface 623*a* are connected via a step portion 621*b*.

At the upper portion of the head portion 623 of the switch 62 illustrated in FIG. 5, there is provided a housing portion 625 which has a substantially circular cross section and is a concave portion opened upward. The housing portion 625 has the same inner diameter as that of the housing portion 615 of the switch 61 described above, and is provided to have substantially the same diameter over the vertical direction. The housing portion 625 can house the cylindrical portion 74 (top surface side light guide portion 741) of the cap 7 in the same manner as the housing portion 615.

The switch 62 has a columnar contact 626 projecting from the lower surface to the downward side (i.e., the circuit board 13 side) at a position substantially on the axis on the lower surface of the base portion 621. The contact 626 is provided facing the contact electrode 132. A conductor portion is provided on the surface of the contact 626 facing the contact electrode 132 by, for example, plating or vapor deposition. Therefore, when the contact 626 comes into contact with the contact electrode 132, the open ends of the contact electrode 132 on the positive electrode side and the negative electrode side can be short-circuited.

A part of the side wall portion 64 in FIG. 3 is provided with a plurality of openings 641 penetrating in the vertical direction (see also FIG. 5). A positioning projection (not illustrated) projecting from the inner surface of the exterior case 11 is inserted and positioned in the opening 641. On the upper surface of the bottom portion 63 of the rubber switch array 6 disposed on the circuit board 13, a plurality of protrusions 111 protruded from the inner surface of the exterior case 11 abut on the upper surface. Thus, the vertical movement of the rubber switch array 6 is regulated. Rectangular groove portions 651 and 652 are provided on the lower surface of the rubber switch array 6. The groove portions 651 are provided over the long length direction (the right and left direction in FIG. 5) of the rubber switch array 6, and connect the internal space S1 between the switches 61 and 62 and the circuit board 13 and the external space S2. The groove portions 652 are provided over the short length direction (the back side and the near side direction in FIG. 5) of the rubber switch array 6, and connect the internal space S1 and the external space S2. The groove portions 651 and 652 can release the air in the internal space S1 when the switches 61 and 62 move up and down to reduce the resistance of the vertical movement.

The cap 7 illustrated in FIG. 3 is formed in a hollow hat shape with its lower surface side opened. The cap 7 is formed in a substantially trapezoidal shape in a side view. A side surface portion 72 provided downward from the outer peripheral edge of the top surface 71 is provided so that its outer diameter is slightly widened toward the lower end portion of the cap. A flange portion 73 of a flange shape projecting in the outer diameter direction is provided at the lower end of the side surface portion 72.

Figure 4:
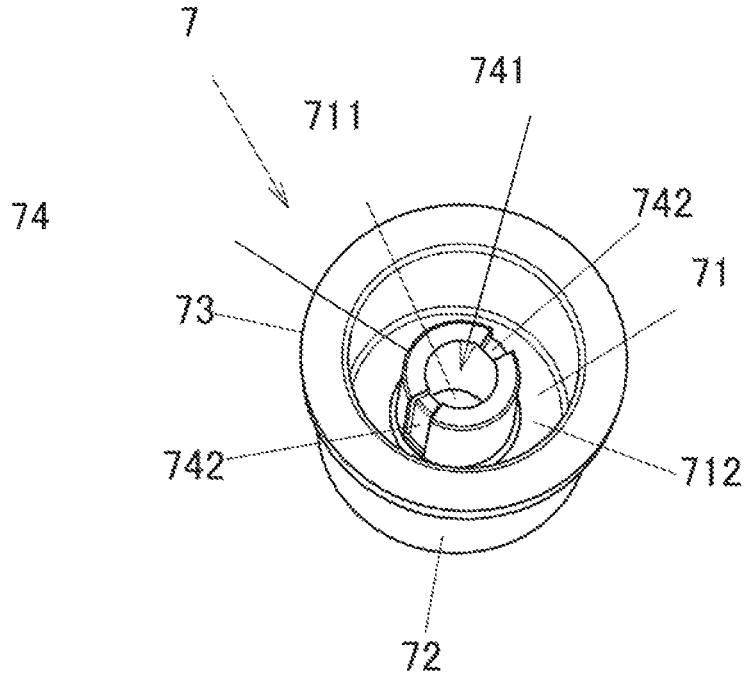
FIG. 4 is a backside perspective view of a cap according to the embodiment.

As illustrated in FIG. 4, the cap 7 has a cylindrical portion 74 extended to protrude from the lower surface of the top surface 71 toward the light emitting element 133 (internal light) side. The cylindrical portion 74 is formed in a cylindrical shape which has an upper end closed by the top surface 71 and an opening at its lower portion. A top surface side light guide portion 741 surrounded by the inner wall of the cylindrical portion 74 is provided inside the cylindrical portion 74. On the outer surface of the cylindrical portion 74, groove portions 742 extending in the vertical direction are provided at two positions. The lower end of the groove portion 742 is provided up to the tip edge portion of the cylindrical portion 74.

As illustrated in FIGS. 3 and 5, the top surface 71 of the cap 7 includes a first region 71*a* and a second region 71*b*. The first region 71*a* corresponds to a thick-walled portion 712 provided annularly on the outer periphery outside the second region 71*b* on the top surface 71. As illustrated in FIG. 3, the second region 71*b* corresponds to a thin-walled portion 711 provided in a substantially circular region on the center side on the top surface 71. The thickness t2 of the thin-walled portion 711 of the second region 71*b* is thinner than the thickness t1 of the thick-walled portion 712 of the first region 71*a*. The above-mentioned top surface side light guide portion 741 is provided inside (on the inner side of) the top surface 71 corresponding to the second region 71*b*. Therefore, the second region 71*b* is disposed on the optical path of the light emitted from the light emitting element 133. The top surface side light guide portion 741 is configured such that the outer periphery of the second region 71*b* is surrounded by an inner wall at the boundary between the second region 71*b* and the first region 71*a* inside the cap 7. The second region 71*b* is provided corresponding to a position where the light emitting element 133 is disposed (see FIG. 5).

The cap 7 of the present embodiment is made of a black translucent resin material and contains a diffusion material. For example, inorganic or organic fine particles can be used as the diffusion material. The diffusion material may be contained in the second region 71*b* and may not be contained in other parts (e.g., the side surface portion 72). The top surface 71 is embossed. The embossing can be formed, for example, on the external surface of the top surface 71 by fine unevenness of about 0.1 mm.

As illustrated in FIG. 5 and other figures, the cap 7 can be mounted to the switch 61 and the switch 62 such that the top surface 71 and the side surface portion 72 cover the head portions 613 and 623. In such a case, the cylindrical portion 74 of the cap 7 is housed in the housing portions 615 and 625 of the respective head portions 613 and 623. The cap 7 and the head portions 613 and 623 can be fixed by bonding the inner wall of the side surface portion 72 of the cap 7 and outer surfaces 613*a* and 623*a* of the head portions 613 and 623 with an adhesive.

In the switch device 4, a tip portion of the cylindrical portion 74 abuts on a step portion between the housing portion 615 and the light side light guide portion 614. In the state where the cap 7 is mounted to the switch 61, the inner diameter of the top surface side light guide portion 741 is formed to be smaller than the inner diameter at the upper end of the light side light guide portion 614. The center axes of the light side light guide portion 614 and the top surface side light guide portion 741 substantially coincide with an optical axis of the light L emitted from the light emitting element 133 (see FIG. 6). Therefore, the light side light guide portion 614 and the top surface side light guide portion 741 form an optical path of the light L emitted from the light emitting element 133. The aforementioned second region 71*b* is positioned on the optical path (in other words, on the optical axis of the light emitting element 133) of the light emitting element 133.

In the switch device 5, the tip portion of the cylindrical portion 74 abuts on the bottom portion of the housing portion 625. The center axis of the top surface side light guide portion 741 in the cylindrical portion 74 substantially coincides with the center axis of the contact 626.

The operations of the switch device 4 and the switch device 5 will then be described. In the initial state (state where no external force is applied) of the switch device 4 illustrated in FIG. 5, the switch 61 and the cap 7 are raised by the elastic force of the skirt portion 612, and the top surface 71 of the cap 7 projects from the upper portion of the exterior case 11. In such a case, contact 616 is separated from the contact electrode 131.

Figure 6:
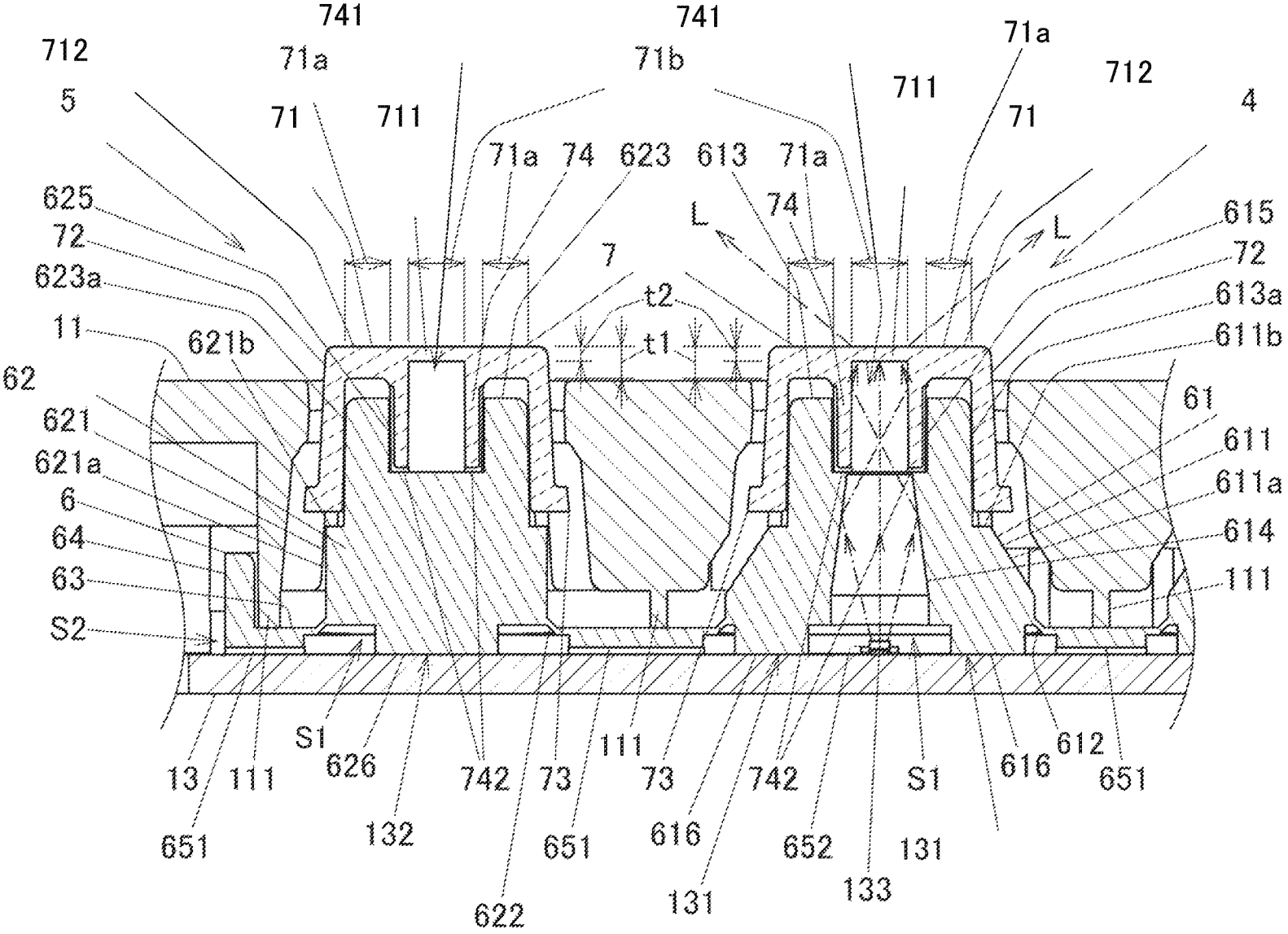
FIG. 6 is a view illustrating a state in which the switch device is operated in a V-V cross section where the area around the switch device of the keyboard instrument in FIG. 1 according to the embodiment is enlarged.

As illustrated in FIG. 6, when the switch device 4 is depressed (the cap 7 is depressed so as to apply an external force downward), the switch 61 and the cap 7 are lowered against the elastic force of the skirt portion 612. The top surface 71 of the cap 7 is positioned closer to the exterior case 11 side than the state in FIG. 5. In such a case, one or both of the two contacts 616 abut on the contact electrode 131 to make one or both of the contact electrodes 131 conductive. The conduction of the contact electrode 131 is detected by a detection unit not illustrated in the figure, and is determined that the depression operation has been performed. Therefore, even when the cap 7 is depressed in the oblique direction, for example, the switch device 4 can accurately determine that the depression operation has been performed.

When the switch device 4 detects that the depression operation has been performed, a processor, which is not illustrated in the figure, such as the circuit board 13 causes the light emitting element 133 to emit light. The processor executes processing corresponding to the operation to the switch device 4 to be detected. The light emitting element 133 has an optical axis substantially perpendicular to the surface of the circuit board 13 and emits light L having a predetermined directivity (or, a half-value angle or a directional angle) upward. A part of the light L emitted from the light emitting element 133 is directly irradiated to the second region 71*b* of the top surface 71, and the other part is reflected by one or both inner surfaces of the light side light guide portion 614 and the top surface side light guide portion 741 and then irradiated to the second region 71*b*. Therefore, the light side light guide portion 614 and the top surface side light guide portion 741 can guide the light L emitted from the light emitting element 133 to the thin-walled portion 711 of the second region 71*b*.

The thin-walled portion 711 of the present embodiment is made of a black resin material having translucency (or having a wall thickness that is thick enough to allow light to pass through). Therefore, the light L emitted to the inner surface side of the thin-walled portion 711 passes through the thin-walled portion 711 and is emitted to the outside from the surface side of the top surface 71. Therefore, the user can visually recognize the light emission of the cap 7 caused by the depression operation of the switch device 4 even in the playing position.

Since the surface side of the thin-walled portion 711 is embossed, the diffusion angle of the light L emitted from the surface of the top surface 71 can be widened while increasing the diameter of the substantially circular light L visually recognized on the surface of the top surface 71 when viewed from the top surface 71 side (e.g., with the diameter of the light being approximately the same as that of the top surface side light guide portion 741). Since the thin-walled portion 711 contains a diffusion material, the emitting angle of the light L emitted from the surface of the top surface 71 can be further widened. Further, since the switch device 4 guides the light L to the top surface 71 side by the relatively hard top surface side light guide portion 741, the circular light L having a clear contour can be emitted from the surface of the top surface 71 (thin-walled portion 711).

When the depression operation of the switch device 4 is released, the switch 61 and the cap 7 are raised by the elastic force of the skirt portion 612, and the switch device 4 returns to the state in FIG. 5. The light emitting element 133 is turned off when the contact 616 and the contact electrode 131 are separated from each other and the conduction of the contact electrode 131 is released. The light emission control of the light emitting element 133 when the conduction of the contact electrode 131 is released can be arbitrarily determined such as to immediately turn off the light or to turn off the light after a predetermined time has elapsed.

In the initial state (state where no external force is applied) of the switch device 5 illustrated in FIG. 5, as in the case of the switch device 4, the switch 62 and the cap 7 are raised by the elastic force of the skirt portion 622, and the top surface 71 of the cap 7 projects from the upper portion of the exterior case 11. In such a case, the contact 626 is separated from the contact electrode 132.

As illustrated in FIG. 6, when the switch device 5 is depressed (the cap 7 is depressed so as to apply an external force downward), the switch 62 and the cap 7 are lowered against the elastic force of the skirt portion 622. The top surface 71 of the cap 7 is positioned closer to the exterior case 11 side than the state in FIG. 5. In such a case, the contact 626 abuts on the contact electrode 132 to make the contact electrode 132 conductive. The conduction of the contact electrode 132 is detected by a detection unit not illustrated in the figure, and is determined that the depression operation has been performed. Also in the switch device 5, a processor not illustrated in the figure executes processing corresponding to the operation to the switch device 5 to be detected.

When the depression operation of the switch device 5 is released, the switch 62 and the cap 7 are raised by the elastic force of the skirt portion 622, and the switch device 5 returns to the state in FIG. 5.

Although the configuration of the present embodiment has been described above with reference to FIGS. 1 to 5, other configurations may be applied. For example, the present embodiment illustrates an example that the cap 7 is black, but the cap 7 may be formed in other colors such as white or red. The light L emitted from the light emitting element 133 is not limited to white but may be other colors. As in the present embodiment, if the cap 7 is black and the light L emitted from the light emitting element 133 is white, the contrast between the color of the top surface 71, which is the emitting surface, and the color of the emitted light L can be increased, and the light L having a clearer contour can be emitted from the top surface 71 (or displayed on the top surface 71).

The cap 7 may be configured not to provide a cylindrical portion 74 protruded to the light emitting element 133 side. For example, the inner surface side of the second region 71*b* of the cap 7 may be provided as a concave portion thinner than the inner surface of the first region 71*a*, so that the top surface side light guide portion 741 may be constituted by the inner peripheral surface of the concave portion. Even in this case, the shape of the inner peripheral surface of the top surface side light guide portion 741 allows light L having a clear contour to be emitted from the top surface 71.

The configuration of the second region 71*b* thinner than the first region 71*a* on the top surface 71 is not limited to a configuration in which the thin-walled portion 711 is provided, but may be a configuration in which a through-hole is provided (i.e., a configuration in which the second region 71*b* has a thickness of zero). In this case, the switch 61 may have a convex portion to be inserted into the through-hole of the top surface 71. The convex portion of the switch 61 is made translucent, so that the light L of the light emitting element 133 from the second region 71*b* can be emitted from the external surface of the top surface 71. On the other hand, in the configuration in FIG. 5 and other figures in which the surface (closed surface) of the top surface is continuous with the external surface of the first region 71*a* without penetrating the second region 71*b* of the top surface 71, when the light L is not emitted from the light emitting element 133, it is difficult to distinguish the boundary between the light emitting portion (second region 71*b*) of the cap 7 and the other portion (first region 71*a*) of the cap 7 when the switch devices 4 and 5 are viewed from the outside. Therefore, a sense of integration can be given to the top surface 71 which is an operation unit of the switch devices 4 and 5.

The present embodiment describes an example that the top surface side light guide portion 741 provided in the cap 7 and the light side light guide portion 614 of the switch 61 are separately configured, but the top surface side light guide portion 741 and the light side light guide portion 614 may be integrally configured. For example, in the switch device 4 illustrated in FIG. 5 and other figures, the cap 7 and the switch 61 may be integrally provided, and the skirt portion 612 can be constituted of a separate elastic member such as rubber.

Although an example in which the light emitting element 133 is disposed as an internal light in the switch device 4 is illustrated, light guided by a light guide member such as an optical fiber may be configured such as to emit the light L to the light side light guide portion 614 side by disposing the emitting side end portion or the leakage portion of the light guide member at the position of the light emitting element 133 illustrated in FIG. 5 and other figures.

Conventionally, there has been proposed a switch device which includes a light emitting portion and emits light by a switch operation. For example, disclosed is a configuration that a switch device (push button device) of JP 2006-302555 A has a rubber switch in which a light guide portion for transmitting light from an LED is formed, and a resin button formed so as to cover a part of an outer wall surface from a light guide surface of the light guide portion of the rubber switch, in which the light guide portion is formed into a shape concentrating and guiding light from the LED to a part of an operation surface of the resin button.

However, in the switch device of JP 2006-302555 A, the resin button positioned on the light guide surface is thick, and the lighting pattern visually recognized on the operation surface side is unclear.

However, the switch devices 4 and 5 of the present embodiment includes: a cap 7, on the top surface 71, including a first region 71*a* and a second region 71*b* which corresponds to a position where an internal light (133) is disposed and is thinner than the first region 71*a*; and switches 61 and 62 to which the cap 7 is mounted. Thus, a clear contour is formed at the boundary between the first region 71*a* and the second region 71*b*, and the light L can be emitted from the second region 71*b*. Therefore, the switch devices 4 and 5 can be configured to allow good visibility of the lighted light L.

The switch devices 4 and 5, in which the second region 71*b* corresponds to the thin-walled portion 711 provided in a region on the center side on the top surface 71 and the first region 71*a* corresponds to the thick-walled portion 712 provided outside the second region 71*b* in the top surface 71, do not emit light L from the thick-walled portion 712, but can emit light L having a clear contour from the thin-walled portion 711, and therefore allow good visibility of the lighted light L.

The cap 7 has, at the boundary between the second region 71*b* and the first region 71*a* on its inside, a top surface side light guide portion 741 surrounding the outer periphery of the second region 71*b* with an inner wall. Thus, the light L from the internal light (133) can be guided to the second region 71*b* side while being reflected by the inner wall of the top surface side light guide portion 741.

In the switch device 4 having a housing portion 615, in which the top surface side light guide portion 741 is cylindrically extended from the top surface 71 side toward the internal light (133) side and for which the switches 61 and 62 house the top surface side light guide portion 741, the cap 7 can be stably mounted to the switch 61 while constituting a light guide path.

The switches 61 and 62 have contacts 616 and 626 for detecting the depression operation by contacting with the contact electrodes 131 and 132, and the switch devices 4 and 5 provided vertically movably can detect the depression operation in response to the vertical movement by the depression operation of the switch devices 4 and 5.

The switch device 4 in which the top surface 71 is embossed can widen the diffusion angle of the light L emitted from the surface of the top surface 71 while increasing the diameter (in the present embodiment, a substantially circular diameter) of the light L visually recognized on the surface of the top surface 71.

The switch device 4 in which the cap 7 contains a diffusion material can widen the emitting angle of the light L emitted from the surface of the top surface 71.

The electronic apparatus, which includes switch devices 4 and 5 and a processor for executing processing corresponding to an operation to the switch devices 4 and 5 to be detected, can perform lighting control of the switch devices 4 and 5 which allow good visibility, and execute processing corresponding to an operation of the switch devices 4 and 5.

The embodiments described above are presented by way of example and are not intended to limit the scope of the invention. These new embodiments may be implemented in various other forms, and various omissions, substitutions, and changes may be made without departing from the spirit of the invention. These embodiments and modifications thereof are included in the scope and the gist of the invention, and are included in the scope of the invention and its equivalents described in the claims.

What is claimed is:

1. A switch device comprising:

a cap including a first region and a second region on a top surface thereof, the second region corresponding to a position where an internal light is disposed and being thinner than the first region; and a switch to which the cap is mounted, wherein:

the switch comprises an elastic material, and the switch includes a skirt portion which is extended in a state in which the skirt portion is not subjected to an external force and which bends in a state in which the switch is depressed via the cap.

2. The switch device according to claim 1, wherein:

the second region corresponds to a thin-walled portion provided in a region on a center side on the top surface, and the first region corresponds to a thick-walled portion provided outside the second region on the top surface.

3. The switch device according to claim 1, wherein the cap includes, on an inside thereof at a boundary between the second region and the first region, a light guide surrounding an outer periphery of the second region with an inner wall.

4. The switch device according to claim 3, wherein:

the light guide is substantially cylindrical and extends from the top surface side of the cap toward the internal light side thereof, and the switch includes a housing for housing the light guide.

5. The switch device according to claim 1, wherein the switch includes a contact for detecting a depression operation by contacting with a contact electrode and is provided so as to be vertically movable.

6. The switch device according to claim 1, wherein the top surface is embossed.

7. The switch device according to claim 1, wherein the cap contains a diffusion material.

8. An electronic apparatus comprising:

the switch device according to claim 1; and a processor for executing processing corresponding to an operation to the switch device to be detected.

9. The switch device according to claim 4, wherein an inner diameter of the light guide decreases from the internal light side toward the top surface side.

10. The switch device according to claim 8, wherein:

the processor turns on the internal light in response to a depression operation of the switch, the switch device is provided in an exterior case having the internal light, and the top surface is moved closer to the internal light side than the exterior case in response to the depression operation of the switch.

11. The switch device according to claim 4, wherein a center axis of the light guide substantially coincides with an optical axis of light emitted from the internal light.

12. The switch device according to claim 1, wherein the second region has a higher translucency than the first region in at least some wavelength ranges.

13. The switch device according to claim 5, wherein the switch includes two of the contacts each disposed at a respective one of two positions across the internal light.

14. The switch device according to claim 13, wherein:

the light guide is substantially cylindrical and extends from the top surface side of the cap toward the internal light side thereof, and a center axis of the light guide substantially coincides with a center axis of the contacts provided at the two positions.

15. An electronic musical instrument comprising:

the switch device according to claim 1; and a processor for executing processing corresponding to an operation to the switch device to be detected.

16. The switch device according to claim 1, further comprising a rubber switch array including a plurality of the switches provided on a flat plate shape bottom portion.

17. The switch device according to claim 16, further comprising groove portions provided on a lower surface of the rubber switch array disposed on a circuit board.

* * * * *